United States Patent [19]

Indra

[11] 4,060,350

[45] Nov. 29, 1977

[54] CYLINDER HEAD MOUNTING ARRANGEMENT FOR A DIESEL INJECTION PUMP

[75] Inventor: Jaromir Indra, Brno, Czechoslovakia

[73] Assignee: Vysoke uceni technicke, Brno, Czechoslovakia

[21] Appl. No.: 671,117

[22] Filed: Mar. 29, 1976

[30] Foreign Application Priority Data

Mar. 27, 1975 Czechoslovakia ..... 2105/75

[51] Int. Cl.[2] ..... F04B 7/04

[52] U.S. Cl. ..... 417/490

[58] Field of Search ..... 417/490, 499, 500, 454; 123/139 AA, 139 AK, 139 BD; 92/86.5, 111

[56] References Cited

U.S. PATENT DOCUMENTS

| | | | |
|---|---|---|---|
| 2,438,190 | 3/1948 | Sheppard | 417/499 |
| 2,877,711 | 3/1959 | Evans | 417/499 |
| 2,930,323 | 3/1960 | Kessner | 417/500 |
| 2,937,637 | 5/1960 | Heiser | 123/139 BD |
| 3,885,895 | 5/1975 | Staudt | 417/499 |

*Primary Examiner*—Carlton R. Croyle

*Assistant Examiner*—L. J. Casaregola

[57] ABSTRACT

An improved, pressure-sealed mounting arrangement for a cylinder head of a diesel-type fuel injection assembly is described. The working cylinder of the pump assembly has an upward axial projection which tightly receives the lower end of a hollow cylinder head along an extended interface to define a pressure-sealed zone, such zone being disposed above the position of maximum upward travel of the cylinder piston. The head exhibits a lateral projection intermediate its ends for contacting the upper surface of the axial extension of the cylinder. Both the cylinder head and the cylinder extension are tightly secured to the upper portion of the pump body that surrounds the cylinder with the use of a threaded arrangement that tightly secures the lateral extension on the cylinder head to the axial extension on the cylinder and which also secures one of such members to the upper portion of the pump body. An annular recess formed in the pressure-sealing zone communicates with an axial passage in the cylinder wall, whose lower end in turn communicates with a passage extending between the inner and outer peripheries of the cylinder wall.

5 Claims, 2 Drawing Figures

CYLINDER HEAD MOUNTING ARRANGEMENT FOR A DIESEL INJECTION PUMP

BACKGROUND OF THE INVENTION

The invention relates to diesel-type injection pump assemblies and more particularly to facilities in such assemblies for securing a hollow cylinder head in pressure-tight fashion within the working cylinder of the pump assembly.

In known pump assemblies of this type, a cylinder head, which defines the upper portion of the working space of the piston carried in the cylinder, supports a conventional discharge valve in its lower end. The upper end of the cylinder head normally carries a threaded fitting for attachment to a pressure conduit.

Because of extremely high pressures generated in the portion of the cylinder adjacent the lower end of the cylinder head, it is necessary to provide efficient sealing between the head and the surrounding cylinder. In the past, such seals have involved the use of accurate threaded connections between the cylinder head and the cylinder, and/or the provision of washers or gaskets.

Each of such expedients has had disadvantages. In particular, the thread-type connection between head and cylinder has been found to deform the associated portion of the cylinder, and to shorten its life. Moreover, in extremely high-pressure applications, the gaskets or washers are also deformed and quickly lose their pressure-sealing properties.

SUMMARY OF THE INVENTION

The improved arrangement of the invention provides an efficient, long-lasting pressure seal between the cylinder head and working cylinder of a diesel-type injection pump. In an illustrative embodiment, the internal seal is provided by an elongated zone of contact between an upper axial extension of the working cylinder and a downwardly projecting lower end of the cylinder head. In addition, both the cylinder head and the axial extension are tightly but removably affixed to the upper portion of the pump body which surrounds the working cylinder.

In one feature of the invention, the cylinder head is provided intermediate its ends with a lateral extension whose lower surface contacts the upper end of the axial cylinder extension. The upper surface of such extension is contacted by a recessed inner portion of an annular member, either a flange or a cap nut. Such annular member is effective to provide tight engagement between the lateral extension and the upper axial extension, while one of such members is threadedly affixed to the top surface of the surrounding pump body.

An annular groove within the elongated pressure-sealing zone on the upper portion of the cylinder extension communicates with the upper portion of an axial passage within the cylinder wall, whereby oil collected within such annular passage is routed through the axial cylinder to be received within a further passage in the cylinder wall extending through the lower portion of the axial passage between the inner and outer peripheries of the cylinder. Such outer periphery is, in turn, in communication with the suction port of a suitable external feeding pump.

In one embodiment, the axial extension of the cylinder is provided with a surrounding shoulder, which abuts directly on the upper surface of the pump body.

The lower surface of the lateral extension on the cylinder head in turn contacts the upper surface of the shoulder, and a separate annular flange, abutting on the top surface of the lateral extension on the cylinder head, is affixed at its radially outer end to the upper portion of the pump body. In another embodiment, the cylinder is supported in the pump body by means of an annular flange surrounding a portion of the cylinder axial extension below an upper threaded end thereof. Such threaded end is contacted by a lower internal threaded portion of a cap nut, whose upper portion surrounds and contacts the upper surface of the lateral projection on the cylinder head.

BRIEF DESCRIPTION OF THE DRAWING

The invention is further set forth in the following detailed description taken in conjunction with the appended drawing, in which.

DETAILED DESCRIPTION

Figure 1:
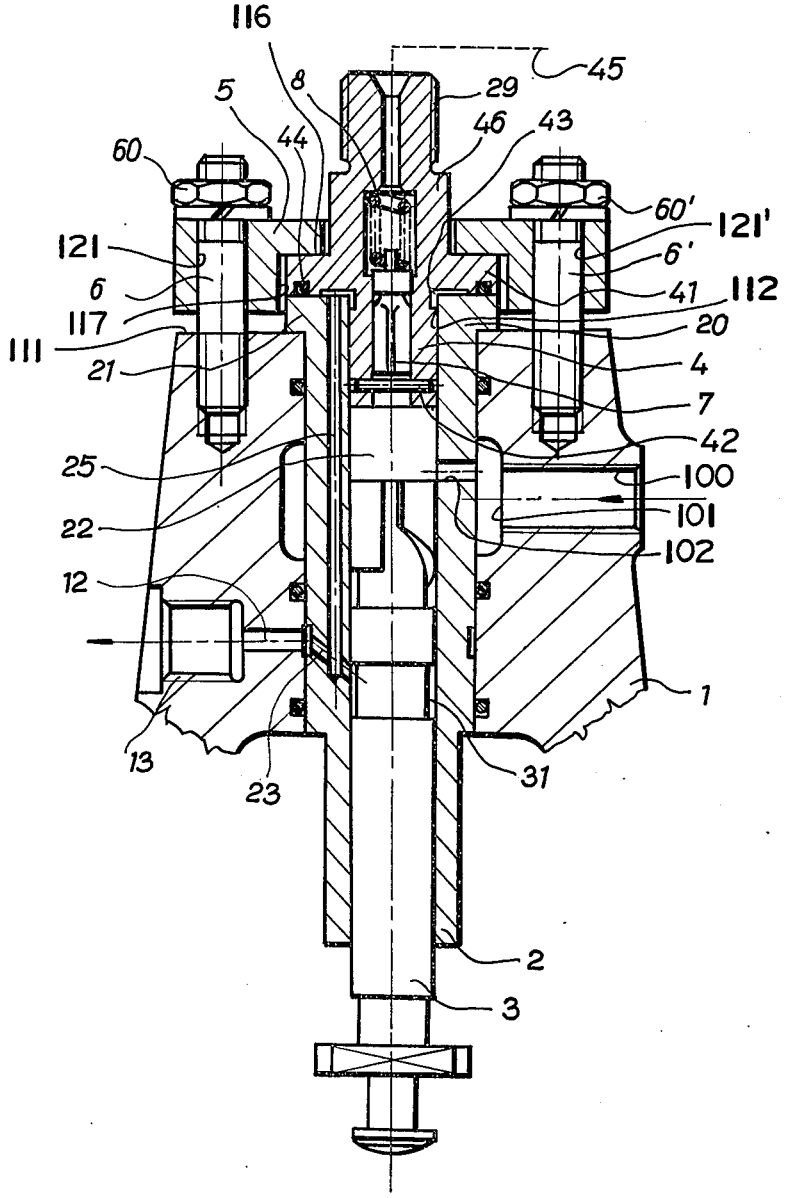
FIG. 1 is a fragmentary view, in longitudinal section, of a diesel-type injection pump assembly having facilities for mounting the cylinder head in the working cylinder in accordance with the invention.

Referring now to the drawing, FIG. 1 illustrates the upper portion of a generally conventional piston-cylinder sub-assembly of the diesel-type injection pump assembly. The assembly includes a vertically disposed, hollow pump body 1 for sealingly receiving a pump working cylinder 2 in coaxial relation therewith. A conventional piston 3 is disposed for reciprocation within the cylinder 2.

In a conventional manner, the pump body 1 is provided with a radial fuel supply channel 100, which communicates with an annular reservoir 101. Fuel from the reservoir 101 is injectable into the cylinder 2 via a radial passage in the wall of the cylinder 2.

Disposed below and opposite the passage 102 is an additional passage 23, which extends obliquely between the inner and outer peripheries of the cylinder 2. The outer end of the passage 23 is in communication with a radial passage 12 in the pump body 1, and the outlet of the passage 12 is associated with a threaded outlet fitting 13 in the pump body 1.

A lower portion of the pump 3 is undercut to provide an annular recess 31, which, in the position shown, communicates with the oblique passage 23 to permit leakage fluid from the interior of the cylinder 2 and collected in the recess 31 to be sucked out of the illustrated assembly by an associated supply pump (not shown) via the passage 23, 12 and 13.

The interior of the cylinder 2 exhibits a working space 22 between the upper portion of the piston 3 and a lower portion of a cylinder head 46. In accordance with the invention, an efficient, long-lasting pressure-tight seal is provided within the working space 22 to prevent the escape of fluid between the cylinder head and the surrounding cylinder wall. For this purpose, the cylinder 2 is provided with an upper axial extension 20 which projects beyond an upper surface 111 of the pump body 1. The cylinder head 46 has an elongated lower end 4 which is disposed within the upper extension 20 of the cylinder 2, thereby defining an elongated, pressure-sealing annular zone 112 between the outer surface of the head end 4 and the surrounding inner surface of the extension 20, without the necessity of separate washers or gaskets or, alternatively, threaded connections within the cylinder 2.

The lower end 4 of the cylinder head 46 carries a conventional discharge valve 7. A downward movement of the valve 7 is restrained by means of a bolt 42 extending transversely in the end 4. A conventional valve operating spring 8 is disposed in a central chamber 113 above the valve 7. A threaded upper end 29 of the head 46 is adapted to receive a pressure conduit, which is schematically depicted at 45. The structure and operation of the valve 7 and its associated spring 8, together with the connection between the threaded end 29 of the head 46 and the conduit 45, are all conventional and will not be described further here.

In the embodiment of FIG. 1, the upper end of the axial extension 20 of the cylinder 2 has a projection 21, whose lower surface abuts the top surface 111 of the pump body 1. The cylinder head 46 is provided intermediate its ends with a lateral extension 41, whose lower surface bears on the top surface of the upper projecting boss 21 on the cylinder. An auxiliary sealing gasket 44 is disposed at the interface between the boss 21 and the overlying, abutting lateral extension 41.

In order to maintain a tight sealing engagement between the lateral extension 41 and the underlying boss 21, and simultaneously to secure the cylinder head 46 and the cylinder axial extension 20 to the pump body 1, an annular flange 5 is disposed in surrounding relation as shown to the head 46 and the cylinder 2.

The flange 5 has an upper, centrally recessed surface 116 which abuts a top surface of the lateral extension 41. An axial bore 117 extends downwardly from the surface 116 to surround the outer surfaces of the lateral extension 41 and the underlying boss 21. A radially outer portion of the flange 5 is provided with a pair of axial bores 121, 121', through which extend a pair of bolts 6, 6'. The bolts 6, 6' are threadedly received in the upper portion of the pump body 1 as shown and are secured by means of nuts 60, 60'. The degree of threading of the bolts 6, 6' into the pump body 1 will exert a corresponding degree of sealing engagement of the boss 21 and the lateral extension 41. Because of the elongated pressure zone 112 established within the cylinder extension 20, the bolts 6, 6' will not be primarily subjected to the high pressures generated within the working space 22 of the cylinder 2.

The lower surface of the transverse extension 41 on the cylinder head 46 is provided with a recess 43, which communicates with an upper end of an axial passage 25, which extends downwardly from the top surface of the extension 20 and terminates at its lower end in communication with the oblique passage 23. With this arrangement, any fluid from the working zone 22 which extends upwardly through the zone 112 can be effectively shunted to the output port 13 of the pump body 1 via the axial passage 25, the oblique passage 23, and the radial passage 12 in the pump body 1.

Figure 2:
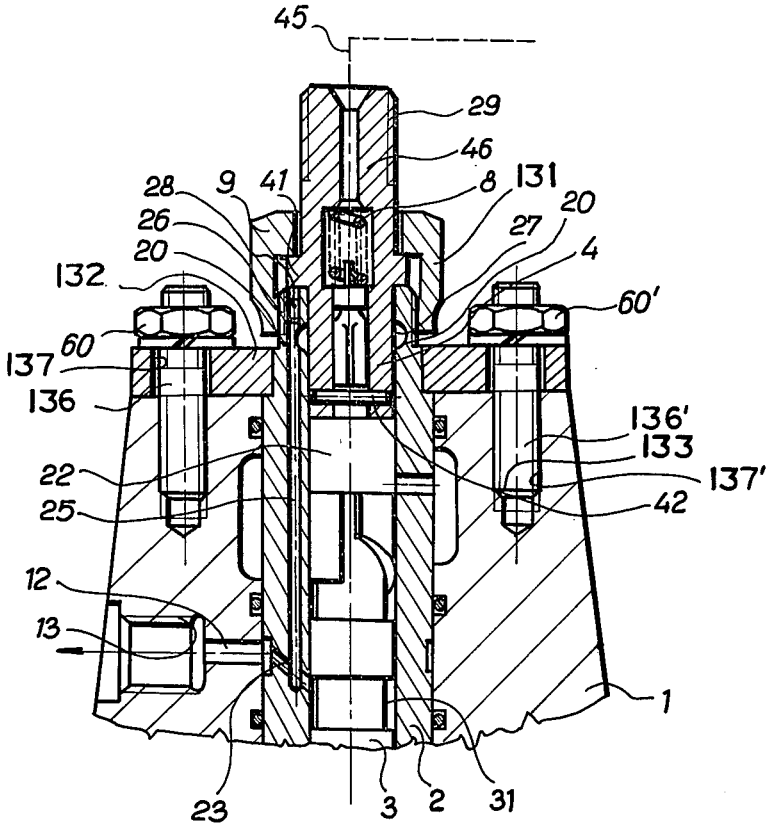
FIG. 2 is a fragmentary view, in longitudinal section, of an alternative arrangement in accordance with the invention for mounting the cylinder head to the working cylinder in the injection pump assembly of FIG. 1.

An alternative arrangement for securing the upper end of the axial cylinder extension 20 and the cylinder head 46 to the upper portion of the pump body 1 is indicated in FIG. 2. The upper end of the axial extension 20 is provided with an external thread 26. Such thread cooperates with an internal thread exhibited by a lower portion 131 of a cap nut 9 which surrounds the head 46. An inner recessed surface 132 of the cap nut 9 abuts a top surface of the lateral extension 41 on the head 46, whereby the degree of tightness between the extension 41 and adjacent upper portion of the extension 20 is proportional to the degree of threading of the lower portion 131 of the cap nut 9 on the thread 26.

A radially inner surface of an annular flange 132 is affixed to a portion of the projecting cylinder extension 20 below the threaded end 26. A lower surface 133 of the flange 132 is disposed in contact with the upper surface of the pump body 1. A pair of bolts 136, 136' extend through axial bores 137, 137' in radially outer portions of the flange 132 to secure such flange to the upper portion of the pump body 1.

In the arrangement of FIG. 2, an annular recess 27 is disposed in the inner surface of the cylinder projection 20, such recess 20 having the function of the recess 43 of FIG. 1. The recess 27 (FIG. 2) communicates with the axial passage 25 in the cylinder 2. A seal 28 is disposed in the portion of the passage 25 above the recess 27, such seal 28 being analogous in function to the auxiliary seal 44 of FIG. 1.

In all other respects, the function and structure of FIG. 2 correspond to those of FIG. 1, with the corresponding elements having identical reference numerals.

In the foregoing, some illustrative arrangements of the invention have been described. Many variations and modifications will now occur to those skilled in the art. It is accordingly desired that the scope of the appended claims not be limited to the specific disclosure herein contained.

What is claimed is:

1. In an injection pump assembly, an elongated, vertically disposed hollow pump body, a working cylinder supported vertically within the pump body, the cylinder terminating upwardly in an extension projecting axially beyond the upper surface of the pump body, the extension having a laterally projecting shoulder in contact with the upper surface of the pump body, a piston supported for vertical reciprocation in the lower portion of the cylinder, a hollow cylinder head having an upper end adapted to receive a pressure fitting, the cylinder head having a lateral extension intermediate its ends, the lower surface of the lateral extension of the cylinder head being disposed in contact with the upper surface of the laterally projecting shoulder of the extension of the cylinder, the cylinder head having an elongated lower end tightly received within the extension of the cylinder to define therewith an elongated pressure-sealing zone, the lower end of the cylinder head terminating within the cylinder in spaced relation to the upper end of the piston when the piston is in its upper position, a hollow cylindrical flange having a radially inner portion in contact with the upper surface of the lateral extension of the cylinder head and a radially outer portion disposed in spaced, superposed relation to the upper surface of the pump body outwardly of the projecting shoulder on the axial extension of the cylinder, and means for securing the radially outer portion of the flange to the upper portion of the pump body.

2. In an injection pump assembly, an elongated, vertically disposed hollow pump body; a working cylinder supported vertically within the pump body, the cylinder terminating upwardly in an axial extension projecting beyond the top surface of the surrounding pump body and exhibiting an outwardly projecting shoulder in contact with the upper surface of the pump body; a piston supported for vertical reciprocation in the lower portion of the cylinder; a hollow cylinder head having an upper end adapted to receive a pressure fitting, a lateral extension intermediate its ends, the lower surface of the lateral extension being disposed in contact with the upper surface of the axial extension of the cylinder, and an elongated lower end tightly received within the axial extension of the cylinder to define an elongated pressure-sealing zone with the surrounding axial extension, the cylinder wall being provided with a first axial passage and a second passage extending through the lower portion of the first passage between the inner and outer periphery of the cylinder wall; the lower end of the cylinder head terminating within the cylinder in spaced relation to the upper end of the piston when the piston is in its upper position; means defining a third passage providing communication between the pressure-sealing zone and the upper end of the first axial passage; a hollow cylindrical flange for centrally receiving the cylinder head, the flange having a radially inner portion in contact with the upper surface of the lateral extension on the cylinder head, and means for securing a radially outer portion of the flange to the upper portion of the pump body.

3. An assembly as defined in claim 2, in which the third passage is an annular groove disposed in the inner wall of the axial extension of the cylinder.

4. In an injection pump assembly, an elongated, vertically disposed hollow pump body; a working cylinder supported vertically within the pump body, the cylinder terminating upwardly in an axial extension projecting beyond the top surface of the surrounding pump body, the upper end of the axial projection of the cylinder having an externally threaded surface; a piston supported for vertical reciprocation in the lower portion of the cylinder; a hollow cylinder head having an upper end adapted to receive a pressure fitting, a lateral extension intermediate its ends, the lower surface of the lateral extension being disposed in contact with the upper surface of the axial extension of the cylinder, and an elongated lower end tightly received within the axial extension of the cylinder to define an elongated pressure-sealing zone with the surrounding axial extension, the cylinder wall being provided with a first axial passage and a second passage extending through the lower portion of the first passage between the inner and outer periphery of the cylinder wall; the lower end of the cylinder head terminating within the cylinder in spaced relation to the upper end of the piston when the piston is in its upper position; means defining a third passage providing communication between the pressure-sealing zone and the upper end of the first axial passage; a hollow cap nut surrounding the cylinder head, the cap nut having an upper portion in contact with the upper surface of the lateral extension on the cylinder head and a lower, internally threaded portion in cooperative relation with the external thread on the axial projection of the cylinder; an annular flange surrounding and secured to the outer surface of the axial extension of the cylinder below the threaded upper end thereof, the annular flange having a lower surface supported on the upper surface of the pump body; and means for securing the annular flange to the upper portion of the pump body.

5. An assembly as defined in claim 4, in which the third passage comprises a recess disposed in the lower end of the lateral extension on the cylinder head.

* * * * *